US006374810B1

(12) United States Patent
Pattullo

(10) Patent No.: US 6,374,810 B1
(45) Date of Patent: Apr. 23, 2002

(54) FUEL AND AIR PURGE SYSTEM FOR DIAPHRAGM CARBURETORS

(75) Inventor: George M. Pattullo, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/482,690

(22) Filed: Jan. 13, 2000

(51) Int. Cl.[7] ..... F02M 37/04
(52) U.S. Cl. ..... 123/516; 123/179.11
(58) Field of Search ..... 123/516, 552, 123/179.11, 179.16; 261/35, DIG. 68, 63

(56) References Cited

U.S. PATENT DOCUMENTS

| | | | | | |
|---|---|---|---|---|---|
| 4,271,093 | A | * | 6/1981 | Kobayashi | 261/34 R |
| 4,335,061 | A | * | 6/1982 | Kobayashi | 261/44 G |
| 4,563,311 | A | * | 1/1986 | Agnew | 261/35 |
| 6,000,369 | A | * | 12/1999 | Koizumi | 123/179.16 |
| 6,202,988 | B1 | | 3/2001 | Abe et al. | 261/34.1 |

FOREIGN PATENT DOCUMENTS

| | | |
|---|---|---|
| JP | 10131807 | 5/1998 |

* cited by examiner

*Primary Examiner*—Henry C. Yuen
*Assistant Examiner*—Mahmoud Gimie

(74) *Attorney, Agent, or Firm*—Reising, Ethington, Barnes, Kisselle, Learman & McCulloch, P.C.

(57) ABSTRACT

A method of reducing gaseous phase presence in the liquid fuel metering chamber of a diaphragm by providing a "High-Point Pick Up" hole positioned in the optimal metering chamber location (highest) to assure maximum purge evacuation of air and/or other gases prior to engine start-up and during running. This optimal location is dependent upon first determining, in advance of carburetor fuel feed circuitry and/or air purge system design, the orientation of the carburetor as mounted on the engine in its primary operator usage position, or so-called "standard operating position" (SOP). This SOP in turn is determined in the first instance by the engine manufacturer and/or the manufacturer of the portable engine-driven handheld appliance on which the engine is mounted. In one embodiment the two typical fluid circuits (air purge and normal idle/high speed fuel feed circuits) share a common, sole take-off inlet opening into the metering chamber, the same being located at the highest elevation point in the metering chamber in the given SOP orientation. This assures that the maximum amount of air and/or fuel vapor is removed from the metering chamber during purging prior to start-up and during running. In accordance with the invention, the primary usage position (SOP orientation) of the engine is determined and becomes a known use parameter prior to the carburetor manufacturer determining such take-off hole location. Both butterfly valve cubic carburetor and rotary valve carburetor embodiments are disclosed embodying the invention.

24 Claims, 7 Drawing Sheets

FUEL AND AIR PURGE SYSTEM FOR DIAPHRAGM CARBURETORS

FIELD OF THE INVENTION

This invention relates to fuel and air purge systems for diaphragm carburetors adapted for use on internal combustion engines, and more particularly for use on small single cylinder four-stroke engines adapted for use on hand-held engine-driven appliances.

BACKGROUND

As a result of emission control legislation in the United States, handheld engine manufacturers have developed various solutions to the tighter exhaust emission limits. One solution is the use of mini-four stroke engines. The 25 to 30 cc mini four-stroke engine market is growing and many manufacturers are using this engine design as opposed to alternative two-stroke technology. Carburetor manufacturers therefore have been challenged to provide diaphragm carburetors, both rotary valve carburetors (RVC) and cubic butterfly valve type, for this market. For cost and other reasons such as proven performance and reliability, the approach has been to calibrate diaphragm carburetors of the type used on two-stroke engines of the same size. This process has been mostly successful although performance problems have surfaced related to all position idle stability and acceleration.

In the development of the present invention and while analyzing the reasons for the stability and acceleration problems, it has been discovered that air bubbles are trapped in the metering chamber of the carburetor which impede fuel flow at idle and during acceleration. The problems described above are not as apparent on two-stroke engine applications since two stroke engines consume about three times as much fuel at idle and wide open throttle (WOT) as four-stroke engines. This additional flow increases the velocity of the fuel passing through the fuel circuits which carries (sweeps) vapor and air bubbles from the metering chamber at a rate such that their formation does not have as much affect on engine performance. Since the four-stroke fuel flow rate is much less, the air bubbles are typically not evacuated and are effectively trapped in the metering chamber, agglomerating as by adhering to corners and crevices in the metering chamber. Further, since these engines may tend to run hotter than their two-stroke counterparts, the four-stroke engine carburetors experience an additional heat load which contributes to vaporization of the fuel in the metering chamber. This vaporization creates more bubbles.

Typically, handheld engine diaphragm carburetors feature an easy starting circuit commonly referred to as the Air Purge System. This system is enabled when the user depresses a flexible squeeze bulb which pumps most of the air out of the carburetor's fuel circuits. A common feature to all carburetors incorporating the Air Purge System is a fuel take off hole inlet for the fuel feeding circuit and a separate check valve inlet for the air purge system, both located in the carburetor metering chamber. Thus, one hole is the inlet from the metering chamber for the air purge routing system, and the other is the inlet from the metering chamber for the fuel circuits supporting the idle and high speed systems. These two holes may be located in different areas within the metering chamber. As a result, the air purge feed hole may not remove enough air/vapor from the metering chamber when operated prior to engine start-up. In this circumstance, upon engine starting, air may be contained in the metering chamber and ingested into the normal idle and high speed fuel circuits. This creates instability at idle and high speed operation since the air creates enleanment when fed into the engine.

Significant effort has been applied to solve the problems of air in the metering chamber. One of the primary prior art solutions identified to date has been to physically position a prior art carburetor on the engine so that the available air purge and fuel circuit feed holes are oriented by carburetor positioning to be generally in the highest position in the metering chamber. This approach has been successful on some engines when the pre-existing feed hole locations happen to match up with the engine manufacturer's determination of the engine-mounted orientation of the carburetor. However, this approach is not acceptable on other engines due to design and other packaging constraints. Moreover, many times the engine designer mandates an orientation of the carburetor on the engine that results in a customer-mandated standard operation position of the carburetor that has been found to adversely affect the evacuation of the air from the metering chamber, resulting in poor all-position idle stability (stalling) and WOT operation (missing).

Another prior art approach has been the so-called "Multi-point" pickup system. This system features three widely spaced apart take off holes opening into the metering chamber cavity surface and all connected to one single downstream passageway feeding fuel through the air purge check valve to the main jet. A fourth hole opening into the metering chamber communicates with an air purge system. This approach is thus complex, costly and provides only partially satisfactory results in terms of solving the aforementioned problems of gaseous phase accumulation in the metering chamber or incomplete evacuation thereof prior to engine start-up.

OBJECTS OF THE INVENTION

Accordingly, among the objects of the present invention are solving one or more of the foregoing problems by providing a new and improved method of reducing gaseous phase presence in the liquid fuel metering of a diaphragm carburetor for an internal combustion engine, such as in the form of excessive air or fuel vapor agglomeration and/or bubble growth due to the same evaporating and/or effervescing from the liquid fuel resident in the metering chamber during engine running, or prior to engine start-up being in the form of an air-filled metering chamber due to carburetor fuel drain-down after engine shut-down.

Another object is to provide an improved method of designing and constructing a diaphragm carburetor of the foregoing character that can be operated to assure that air and vapor bubbles are consumed during the Air Purge starting operation and/or during normal engine operation, and by so consuming this air/vapor volume the engine will exhibit stable all-position idle performance as well as consistent acceleration and provide open throttle (WOT) stability.

A further object is to provide an improved method of the foregoing character that renders the diaphragm carburetor capable of removing the maximum amount of air present in the metering chamber during the actuation of the Air Purge System bulb, and/or that minimizes air bubbles or vapor collecting in the metering chamber during engine idle and WOT operation, and that can also be used with carburetors not equipped with an Air Purge System, and that is applicable to both rotary valve carburetors (RVC) and cubic butterfly type carburetors, and indeed, works well independent of the throttle valve design type.

Still another object is to provide a new and improved diaphragm carburetor designed and constructed in accordance with the foregoing method and operable to produce the improved results achievable by following such method.

SUMMARY OF THE INVENTION

In general, and by way of summary description and not by way of limitation, the invention achieves the aforestated objects through special fuel routing in the fuel circuitry of the carburetor. A "High-Point Pick Up" hole is positioned in the optimal metering chamber location (highest) to assure the maximum evacuation of air during start and running. This optimal location is dependent upon first determining, in advance of carburetor purge system design, the orientation of the carburetor as mounted on the engine in its primary operator usage position, or so-called "standard operating position" (SOP), and which in turn is determined in the first instance by the engine manufacturer.

Preferably the two typical fuel circuits (air purge and normal idle/high circuits) in diaphragm carburetors are consolidated into one circuit sharing a common sole take-off hole or opening into the metering chamber, and which in turn is so located at the highest point in the metering chamber in the given SOP orientation. This approach assures that the maximum amount of air is removed from the metering chamber during purging. This can be achieved in cubic butterfly valve type carburetors of existing design by the appropriate body machining passage routing of the high-point take off. Many variations are possible. The key is to locate the common take off hole (purge feed and fuel circuit feed) in the highest position within the metering chamber, assuming the primary usage position (SOP orientation) of the engine is a given and known parameter prior to determining such take-off hole location.

Likewise, by utilizing the appropriate body machining passage routing of the high-point take off, the same result can be achieved on an existing typical rotary valve carburetor (RVC). Again, this take off hole can be anywhere in the RVC metering chamber in order to achieve pick up at a predetermined and known SOP metering chamber high-point.

BRIEF DESCRIPTION OF THE DRAWINGS

The foregoing as well as further objects, features and advantages of the invention will become more apparent from the following detailed description of preferred embodiments of the invention constructed in accordance with the best mode presently known to the inventor for making and using the same, and from the accompanying drawings (which are machining drawings drawn to engineering scale unless otherwise indicated) wherein:

FIGS. 3, 4, 5 and 11 are engineering machining views drawn to engineering scale and illustrating in elevation an improved cubic carburetor of the invention as modified in accordance with the method of the invention to operate in a standard operating position (SOP) with the carburetor oriented as illustrated in FIGS. 3–13 and wherein:

FIG. 3 is an elevational view of the pump face side of the carburetor body.

FIG. 4 is a end view wherein the axis of the throttle bore is perpendicular to the plane of the drawing paper.

FIG. 5 is an elevational view of the metering chamber face side of the carburetor body of FIGS. 3 and 4.

FIG. 11 is a top plan view of the carburetor of FIGS. 3, 4 and 5.

FIGS. 15–28 illustrate in various plan and cross sectional views how the pump body of the prior art carburetor of FIG. 14 may be modified in one embodiment of the invention in order to solve the aforementioned idle instability and faulty acceleration problems that have been found to occur when the prior art carburetor of FIG. 14 is oriented as mounted as illustrated in FIG. 14 to accommodate the engine and/or appliance manufacturer's carburetor mounting orientation for SOP, and wherein:

FIG. 15 is a plan view of the metering chamber side of the pump body and oriented by way of example as it would be mounted for meeting a given standard operating position specification of a particular engine manufacturer.

FIG. 16 is a cross sectional view taken on the line 16—16 of FIG. 15.

FIG. 17 is a fragmentary end face view projected in alignment with the axis of the section line 22—22 of FIG. 15.

FIG. 18 is a cross sectional view taken on the line 18—18 of FIG. 17.

FIGS. 19, 20, 21, 22 and 23 are cross sectional views taken respectively on the section lines 19—19, 20—20, 21—21, 22—22, and 23—23 of FIG. 15, all of these views but FIG. 21 being fragmentary cross sectional views.

FIG. 24 is an elevational view of the pump side of the modified pump body of FIGS. 16–23.

FIGS. 25, 26, 27 and 28 are fragmentary cross sectional views taken respectively on the lines 25—25, 26—26, 27—27 and 28—28 of FIG. 24.

DETAILED DESCRIPTION OF PREFERRED EMBODIMENTS OF THE INVENTION

Prior Art Cubic Carburetor With Prior Art Air Purge System

Figure 1:
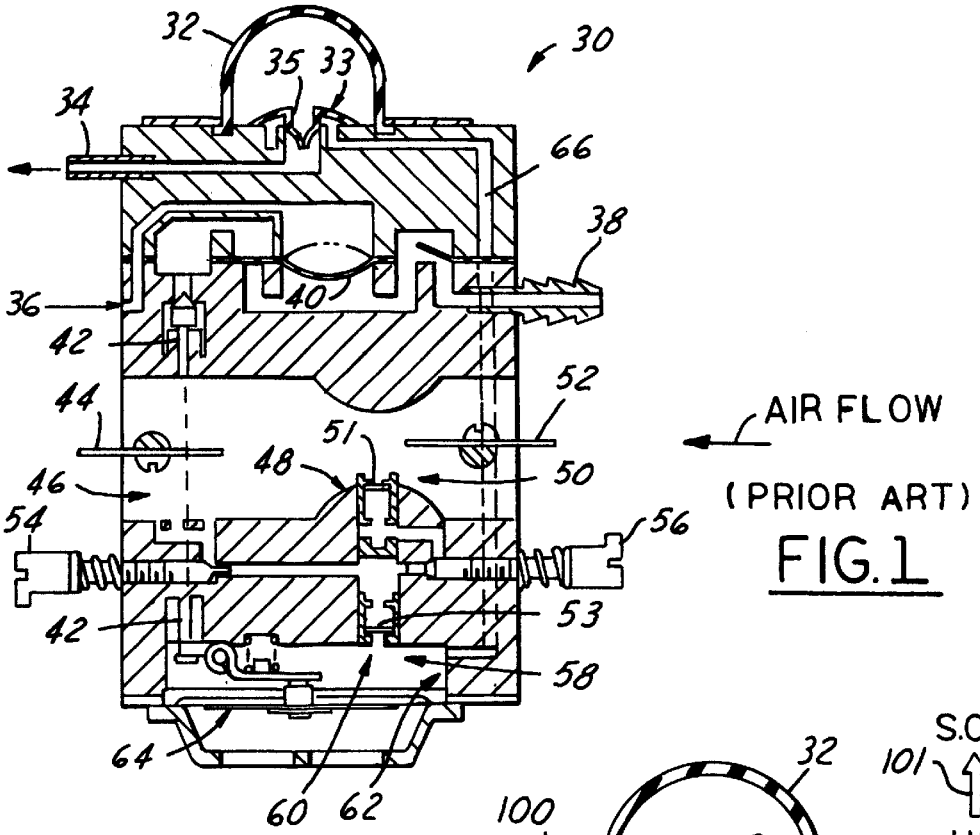
FIG. 1 is a simplified schematic vertical center sectional view of a cubic type carburetor of standard design provided with butterfly type throttle and choke valves in the main fuel/air mixing through-passageway (throttle bore) of the carburetor.

FIG. 1, by way of background information and environmental structure, illustrates schematically a standard design prior art cubic carburetor 30 constructed with the following conventional and well known components:

| Part Name | Part Number |
|---|---|
| Air Purge System Squeeze Bulb | 32 |
| Combined Umbrella and Duck Bill Inlet and Outlet Valve Member for Air Purge System | 33 |
| Air and/or Fuel Return Line To Tank From air purge system | 34 |
| Crank Case Pulse Passageway For Operating Built-in Diaphragm Pump | 36 |
| Nipple for Receiving Flexible Supply Hose From Fuel Tank Source | 38 |
| Fuel Pump Diaphragm with integral inlet and outlet flat valves | 40 |
| Inlet Needle Valve | 42 |
| Butterfly Throttle Valve | 44 |
| Throttle bore | 46 |
| Venturi | 48 |
| Nozzle | 50 |
| Main Jet Check Valve | 51 |
| Butterfly Choke Valve | 52 |
| Fuel Feed System Inlet Check Valve | 53 |
| Idle Needle | 54 |
| High Speed Needle | 56 |
| Metering Chamber | 58 |
| Fuel Pick-Up Hole from Metering Chamber for Fuel Feed Circuit | 60 |
| Air Purge Pick-Up Hole from Metering Chamber For Air Purge Passageway Circuit | 62 |
| Metering Diaphragm | 64 |

As is well known in the art, diaphragm-type carburetors were developed many decades ago for use on small single cylinder two-stroke cycle engines adapted to be mounted on and part of handheld engine-driven appliances, such as chain saws, hedge trimmers etc. because this type of carburetor offered all-position operation capability as compared to the limited position capability of the float-in-bowl type carburetor in common use since the beginning of the twentieth century. Regulation of the inlet needle valve 42 by means of a diaphragm 64 versus a float was, of course, the key to achieving all-position operation for such handheld two-stroke single cylinder engines.

The air purge system for carburetor 30 was developed some years after the introduction of the diaphragm carburetors and provided an air purge passageway system and associated manually-operated purge pump for pumping air out of the metering chamber 58 prior to engine start-up. This causes liquid fuel to be drawn from the fuel source via nipple 38, pump passages of the fuel pump and past inlet valve 42 and into metering chamber 58 to fill the same with liquid fuel to properly condition carburetor 30 for engine start-up. The air purge system included an air purge pick-up hole 62 opening to the metering chamber cavity in the pump body at a location spaced from the fuel pick-up or "takeoff" opening 60. During engine operation, liquid fuel is aspirated from the metering chamber 58 into the fuel feed circuit via fuel take-off opening 60 and then through the fuel feed passageways as controlled by the idle needle 54 and high speed needle 56 and the setting of butterfly valves 44 and 52. The air purge pick-up hole 62 communicated via a purge passageway 66 and the umbrella valve 33 with the interior of the air purge system squeeze bulb 32. The outlet of this purge pump communicated via the duck bill portion 35 of valve 33 with the return line 34 leading back to the fuel source, typically the fuel tank also mounted on the handheld engine.

Thus, prior to engine start-up, when bulb 32 was initially squeezed to ensmall its interior air chamber, typically first air was forced via duck bill 35 back to the tank. When bulb 32 was then released and allowed to expand to its free state condition shown in FIG. 1, the negative pressure thereby developed sucked air from the metering chamber via purge passageway 66 past the umbrella flap of valve 33 into the interior of the squeeze bulb. Such respective squeezing and releasing of bulb 32 thus is effective to purge the fuel feeding system of air (at least upstream of check valve 53) and to draw in liquid fuel to thereby condition the same for engine start-up, even though such air purging may leave a residual air bubble in the highest elevation area of metering chamber 58.

Typically, the standard operating position (SOP) of carburetor 30 was generally in the normal upright orientation illustrated in FIG. 1 with throttle 46 oriented horizontally and the metering chamber disposed below the throttle bore and bulb 32 facing upwardly. Under such start-up orientation conditions, and when used on a two-stroke cycle engine, the presence of a residual air bubble after completing the start-up air purging operation does not pose a significant fuel feeding problem, i.e., of sufficient severity to adversely affect engine start-up or run performance, for the reasons set forth previously hereinabove in the Background section.

However, in trying to employ the typical prior art diaphragm carburetor 30 to feed fuel to the aforementioned mini-four-stroke single cylinder engine designed with a displacement in the aforementioned 20–35 cubic centimeters, and more particularly 25–30 cubic centimeters, and when the engine and/or engine-driven appliance manufacturer mandated a standard operating position (SOP) requiring a different orientation of carburetor 30 from the typical orientation shown in FIG. 1, the aforementioned problems of idling stability and faulty acceleration performance surfaced.

First Embodiment of the Invention

Figure 2:
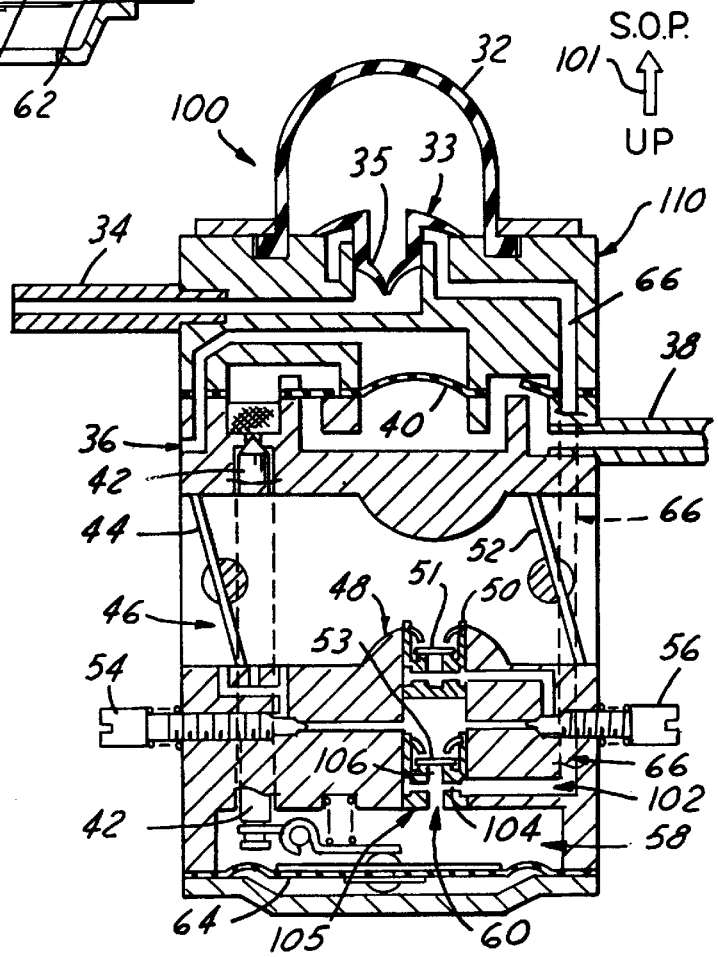
FIG. 2 is a simplified schematic view showing an improved cubic type carburetor of the type shown in FIG. 1 as modified in accordance with the method of the invention and having a standard operating position (SOP) wherein the axis of the throttle bore is oriented horizontally, the metering chamber is disposed at the bottom of the carburetor body parts and the carburetor-mounted air purge bulb is disposed at the top of the carburetor.

FIG. 2 illustrates schematically the same type of diaphragm carburetor as described and illustrated in connection with the prior art carburetor 30 of FIG. 1, but modified in accordance with the method of the invention to provide an improved carburetor 100 of the invention capable of solving the aforementioned problems and thereby achieving all-position idle stability for mini-four-stroke engines while yet utilizing a diaphragm carburetor of current design and manufacture as intended initially and primarily for use on two-stroke single cylinder engines. Those elements of carburetor 100 common to carburetors 30 and 100 are given the same reference numerals and their description not repeated. Thus, it will be seen that, in accordance with the method of invention, a diaphragm type carburetor 100 is provided having the usual components and generally arranged into the same organization and functioning in for cooperation to work in generally the same mode of operation as the existing carburetor 30. This approach offers the greatest opportunity for rapidly and economically adapting diaphragm carburetors in accordance with the invention for use with mini-four-stroke single cylinder engines designed for powering handheld appliances.

In accordance with the present invention it has been discovered, in analyzing the problems encountered with attempting to adapt diaphragm carburetors from two-stroke cycle single cylinder engine use to mini-four-stroke single cylinder engines, that it is necessary for the carburetor designer to first determine what will be the highest elevation region in the metering chamber of the diaphragm carburetor when mounted on the engine in accordance with engine manufacturer's (or its customer's) SOP specification, with the engine-mounted carburetor and engine together being oriented in such standard operating position (SOP). Once the problem and its causes were so discovered and understood, it was evident that there could be no "universal" design that would work satisfactorily regardless of whatever SOP was specified by the engine manufacturer and/or handheld appliance manufacturer due to the variety of handheld appliance designs and their diverse orientations for the particular usage intended. Thus, the method of the invention also contemplates adapting a standard diaphragm carburetor with the parameter of SOP being ascertained and thus known in advance of design and adaptation of the carburetor by the carburetor manufacturer.

Referring again to FIG. 2, it will be seen that, in the case of the carburetor 100 illustrated schematically in FIG. 2, the adaptation provided contemplates an SOP specified for the engine-mounted carburetor as being that of the orientation of carburetor 100 in FIG. 2, i.e., the axis of bore 46 disposed horizontally and the axes of bulb 32 and diaphragm 64 being oriented vertically relative to earth gravitational orientation. With this SOP being known and given, it will be seen that the fuel pick-up hole 60 is provided in the roof of the cavity defining the metering chamber 58, and more particularly in the region of highest elevation in chamber 58 for this given SOP.

In addition, since carburetor 100 is preferably also equipped with an air purge system, the air purge passageway 66, instead of being connected into a take-off port or hole spaced from fuel take-off 60 and located in a side wall of the metering chamber cavity, as in carburetor 30, carburetor 100 is provided with a branch inlet purge passageway 102 leading to an inlet port 104 in a fitting 105 defining the fuel pick-up hole 60 opening into chamber 58. The downstream inlet 106 to the fuel feeding circuit and located upstream of the fuel feed check valve 53 is also provided in this same fitting 105. Thus it will be seen that both the purge system inlet 104 and the fuel feed circuit inlet 106 share a common and solitary pick-up or take-off opening 60 that is directly formed in the wall of the metering chamber 58. Both inlet 106 and inlet 104 thus directly communicate, via the common pick-up hole 60, with the same head space region of metering chamber 58, which by the principal design parameter of the invention is to be the highest elevation region of the metering chamber for the SOP parameter for which carburetor 100 is designed pursuant to this exemplary but preferred embodiment of the method of the invention.

FIGS. 3–13 illustrate by way of engineering machining drawing views to scale how the method of the invention, as shown schematically in FIG. 2 applied to the carburetor 100, is actually engineered and applied to an existing design of a cubic carburetor designed to operate with butterfly valves. These engineering views of FIGS. 3–13, as well as those of FIGS. 15–28, being made to scale in the appended drawings are therefore incorporated by reference into this disclosure and specification. FIGS. 3, 4, 5 and 11 are views of the carburetor body 200, and in all of these views the carburetor body is shown in elevation, as well as in the sectional views taken from the elevation views, with the carburetor body oriented to satisfy the predetermined and designated SOP, i.e., calling for the carburetor to be turned on its side so that the side face 202 faces upwardly when the carburetor is mounted on the particular mini-four-stroke engine and that engine mounted on a predetermined and specified engine-driven appliance. The "SOP Up" orientation arrow 204 shown between FIGS. 3 and 4 thus applies to FIGS. 3, 4, 5 and 7.

Figure 3:
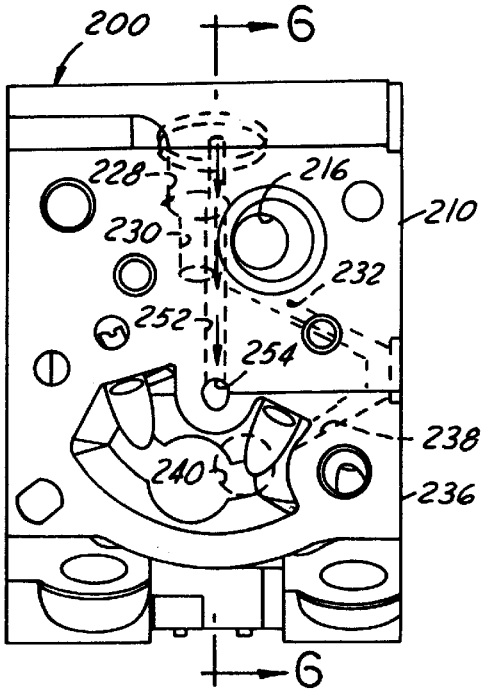
Figure 4:
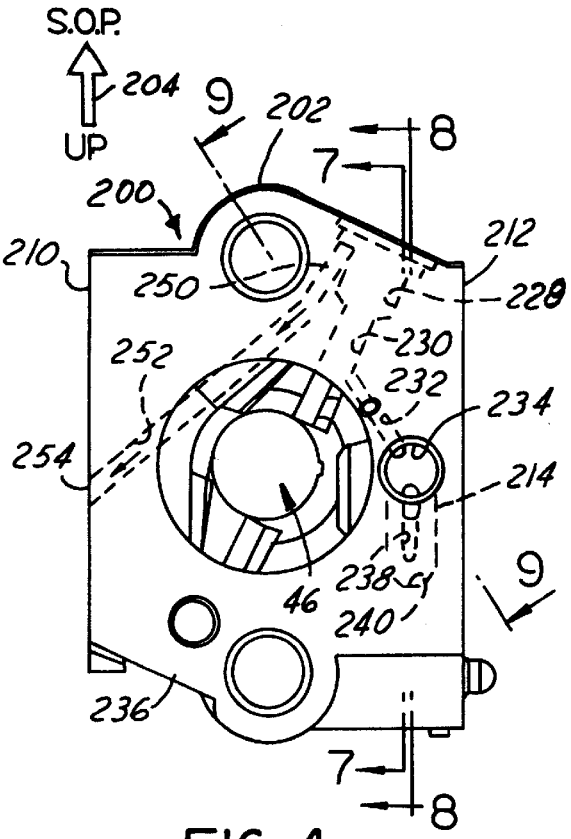
Figure 5:
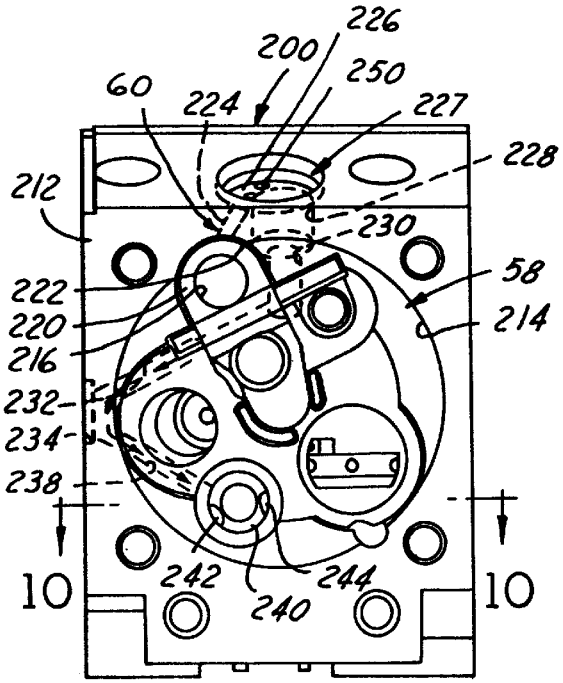
Figure 6:
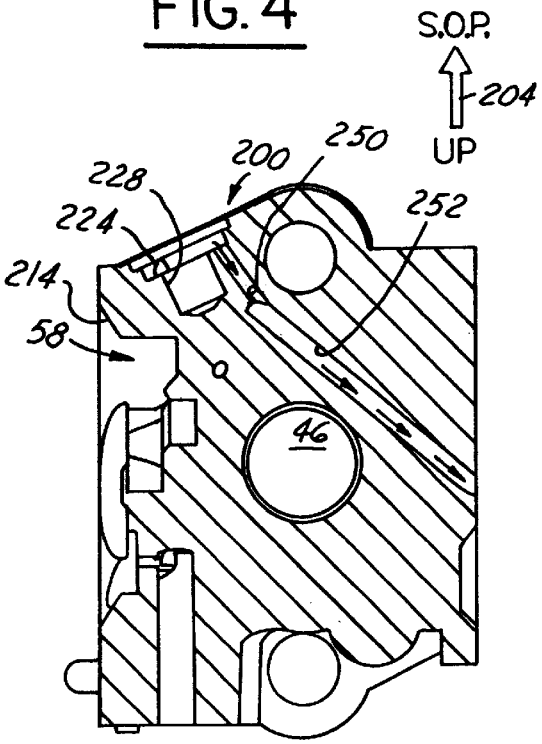
FIG. 6 is a cross sectional view taken on the line 6—6 of FIG. 3.

The upper pump body part 110 of carburetor 100 is not shown in FIGS. 3–12 but is adapted to mount on what would normally be the top face 210 of the cast and machined carburetor body 200, the bottom face 212 of body 200 thus being a mold-formed cavity 214 (FIG. 5 and 6) that will define the roof of the metering chamber 58. A through-bore 216 for receiving the inlet needle valve 42 is seen in FIGS. 3 and 5, as well as in FIG. 7.

It will be seen from FIG. 5 that the step shoulder surface 220 that surrounds inlet needle bore 216 where it enters the metering cavity recess 214 (when the cavity is covered by the diaphragm 64 to thereby define the metering chamber 58 therebetween) is located in the highest elevation region of cavity 58 for the designated or predetermined SOP orientation for the carburetor body 200. On the other hand, if carburetor 100 were oriented for the given SOP 204, diaphragm 64 would lie in the vertical plane, and likewise as to diaphragm 64 of carburetor 30 if mounted for the given 204 SOP orientation. Hence it now will be seen that neither of these carburetors 30 or 100, if utilized for the SOP 204 orientation of carburetor body 200, would satisfy the requirement of the invention that the take-off point from the fuel metering chamber for the fuel feeding circuit, and likewise the take-off point for the air purge circuit if the carburetor is provided with the same, be communicated to the highest elevation region of the diaphragm metering chamber.

Figure 7:
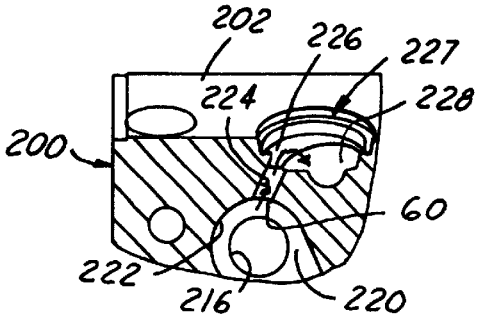
FIGS. 7, 8, 9 and 10 are fragmentary cross sectional views taken respectively on the lines 7—7, 8—8, 9—9 of FIG. 4 and 10—10 of FIG. 5.

Therefore, to apply the method of the invention to carburetor body 200 for the SOP 204 orientation, the "high-point" pick-up location 60 is located as shown in FIGS. 5 and 7 in the side wall 222 made by the partial counter bore in face 212 and terminating at shoulder 220. For this purpose a short solitary and common take-off passageway 224 (FIG. 7) is drilled in body 200 so as to run from opening 60 at its upstream end and open at its downstream end into the step surface 226 of the cavity of a connecting well 227 that also has a counter bore defining its maximum diameter at face 202 for receiving a welch plug (not shown) for sealing of the well cavity. A check valve cavity 228 also opens into well 227 for mounting a fitting (not shown) corresponding to fitting 105 and containing the check valve 53 of the fuel feed circuit (FIG. 2).

Figure 8:
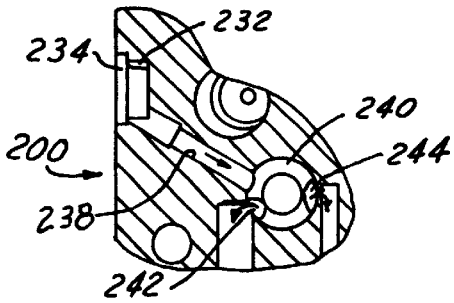
Figure 9:
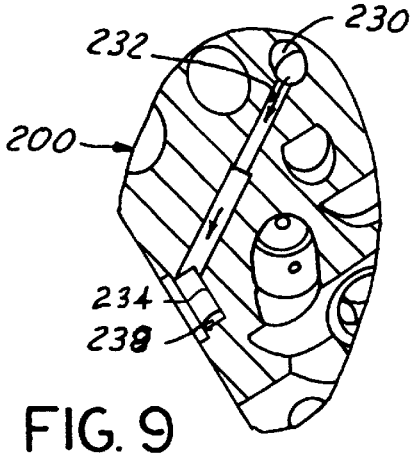
Figure 10:
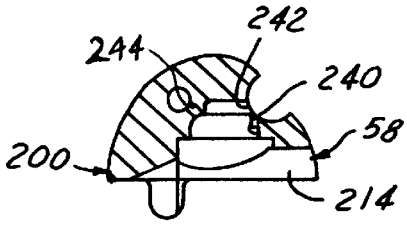
Figure 13:
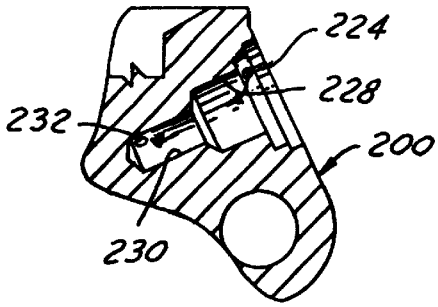
FIGS. 12 and 13 are fragmentary cross sectional views taken respectively on the lines 12—12 and 13—13 of FIG. 11.
Figure 11:
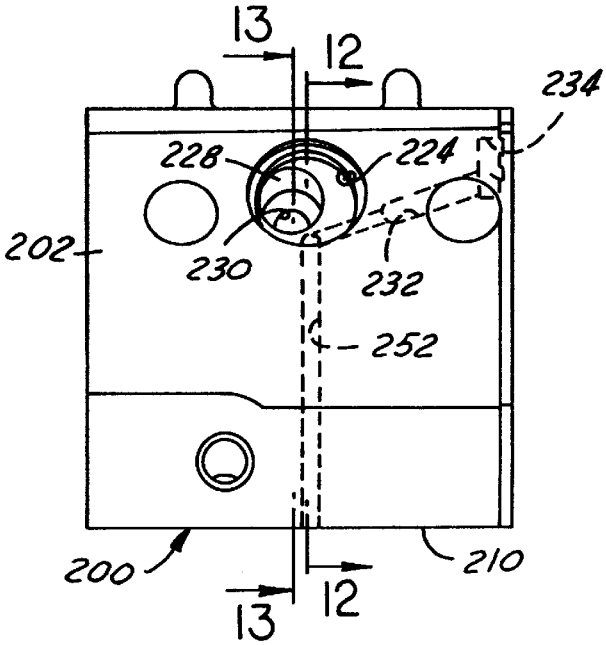
Figure 12:
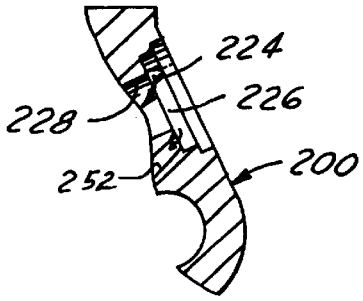

The fuel feeding passageway system branches off from the communicating well 227 and is formed by a reduced diameter blind bore 230 connected by a cross-drilled passageway 232 to a well cavity 234 opening out into the end face 236 of body 200. Cavity 234 forms a communicating connecting well and is also adapted to be sealed by a welch plug seal (not shown) received in the counter bore provided in end face 236. Another fuel feed circuit passageway 238 is cross-drilled in body 200, opening at its inlet in well cavity 234 and extending over to another connecting well cavity 240, likewise cast and machined and located in the roof of metering cavity 214, and again closed by a welch plug seal (not shown). The high speed needle branch passageway feeds off of a port 242 communicating with well 240, and the low speed or idle fuel feed branch passageway feeds off a port 244 also entering into well 240 (FIGS. 5, 8 and 10).

Since carburetor body 200 is to be utilized in this system in assembly with carburetor 100, as reoriented for a new SOP 204, in accordance with the method of the invention the air purge system metering chamber take-off point is also located to communicate with the highest elevation region 60 of the metering chamber 58. Preferably this is accomplished by using the take-off passage 224 of the fuel feeding circuit as a common inlet passage for both the fuel feeding and air purge circuits. To this end an air purge pick-up passageway 250 is drilled into well 227 and connects to another drilled passage 252 (FIGS. 3, 4, 6 and 11) that slants and runs to the pump body (110) mounting face of main body 200. The opening 254 (FIG. 3) of passage 252 in face 210 is adapted to register with the purge passageway 66 in the pump body 110 (refer back to the schematic showing in FIG. 2). In this manner the air purge bulb 32 and associated inlet and outlet umbrella valve 33 are coupled operably to air purge passageway 252 for pumping air and/or fuel from the fuel metering cavity and fuel feed circuit passageway system and out through the duck bill 35 and then out the return line 34 back to the fuel tank.

It will thus be seen from the engineering machining drawing views of FIGS. 3–13 that a standard design cubic carburetor body can be readily modified by providing further cast cavities and/or machined cavities and associated drilled passageways and communicating wells closed by welch plug seals to economically form a passageway network in main body 200 to accomplish the mode of operation set forth schematically for carburetor 100 in FIG. 2 and described hereinabove. Thus by performing the method of the invention the carburetor 100 has been adapted for a new carburetor orientation operable for the new standard operating position (SOP) 204 (versus SOP 101 of FIG. 2) in order to achieve the foregoing objects of the invention by solving the aforestated idle instability and acceleration problems experienced with attempting to use an existing or supposedly universal design diaphragm carburetor and therefore mismatch mounted on a mini-four-stroke single cylinder handheld appliance engine. It also will now be understood that carburetor 100 of FIG. 2 and the related carburetor using main carburetor body 200 are actually two separate species of the first embodiment carburetor and method of making the same.

Second Embodiment Prior Art

Figure 14A:
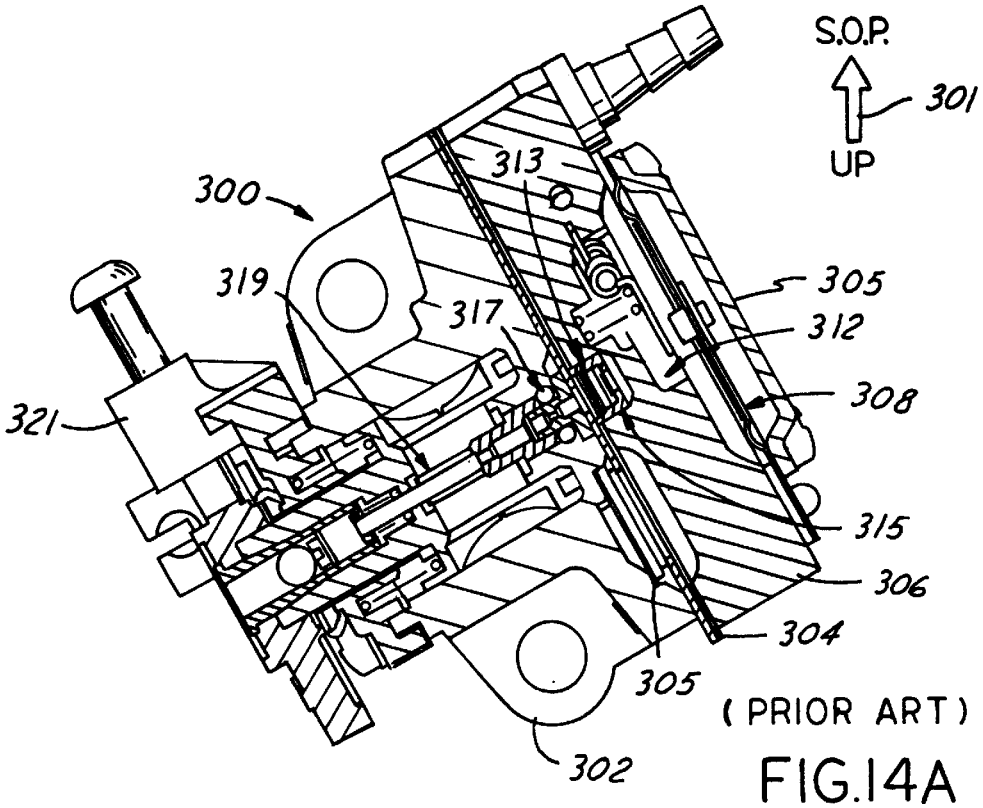
(PRIOR ART) FIG.14A
FIG. 14A is a vertical center sectional view drawn on an engineering scale and illustrating in assembly a prior art diaphragm carburetor of the rotary valve type (RVC) shown oriented as it would be positioned on a given engine and appliance design if mounted in accordance with the engine manufacturing design specification for a given standard operating position (SOP) as determined in the first instance by the engine manufacturer and/or manufacturer of the handheld appliance on which the engine (with carburetor) is to be mounted.
Figure 14B:
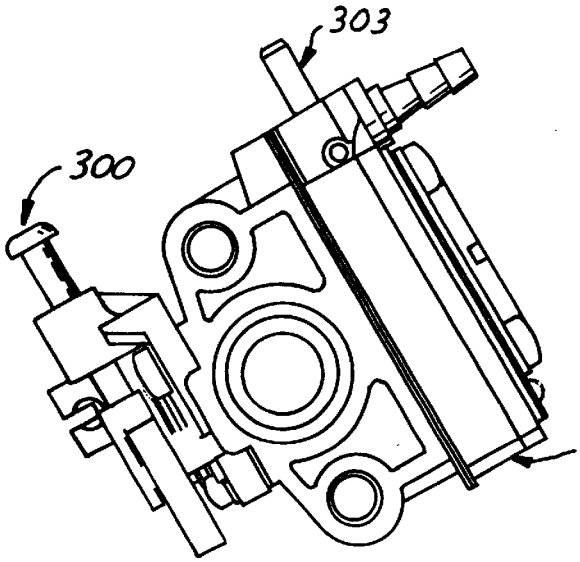
(PRIOR ART) FIG.14B
FIGS. 14B and 14C are end and side elevational views respectively of the carburetor shown in FIG. 14A.
Figure 14C:
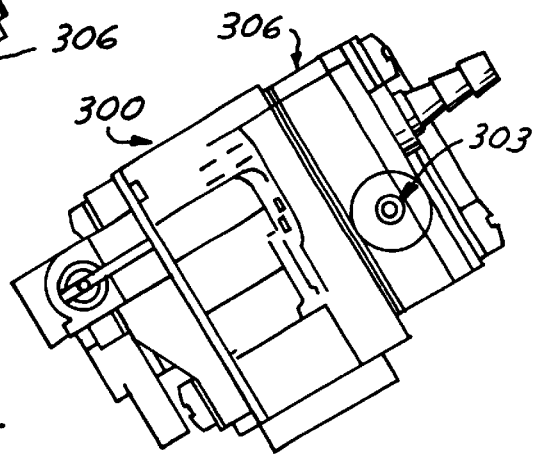
(PRIOR ART) FIG.14C

FIG. 14 illustrates a center sectional assembly view of a standard prior art design rotary valve carburetor (RVC) 300 comprising the following well known components:

| Part Name | Part Number |
|---|---|
| Carburetor Body | 302 |
| Fuel Supply, Crank Case | 304 |
| Pulse Operated Pump Diaphragm | |
| Pump Spring | 305 |
| Fuel Pump and Metering Chamber Body | 306 |
| Air Purge Pump Fitting | 303 |
| Diaphragm Cover | 305 |
| Metering Diaphragm | 308 |
| Metering Chamber | 312 |
| Fuel Feed Circuit Check Valve | 313 |
| Check Valve Fitting | 315 |
| O-ring Seal | 317 |
| Main Nozzle Subassembly | 319 |
| Rotary Throttle Cam Drive Subassembly | 321 |

Carburetor 300 as conventionally designed has separate take-off ports (not shown), one for the fuel feeding circuit passageway system leading nozzle 319 and the other for the air purge passageway system leading to purge pump subassembly (not shown) containing an umbrella valve and squeeze bulb pump components. Alternatively, carburetor 300 is typically manufactured or designed to be oriented with such as purge pump integrated with and disposed beneath the carburetor body 302 and the cam drive throttle subassembly 321 disposed at the top of the carburetor. However, carburetor 300 will work satisfactorily in the orientation shown in FIG. 14 wherein it is rotated approximately 120 or 130 degrees from its aforementioned normal position, if the same is being used in conjunction with a typical two-stroke cycle single cylinder, small displacement engine mounted on a handheld appliance for powering the same. However, carburetor 300 of the prior art will not be operable to perform satisfactorily when oriented as shown in FIG. 14 when so mounted on and intended for use with a mini-four-stroke single cylinder engine of the aforementioned category.

Second Embodiment

Accordingly, as shown in FIGS. 16–28 the prior art RVC carburetor 300 is modified to operate satisfactorily in the SOP orientation of arrow 301 in FIG. 14 in accordance with the method of the invention to thereby render carburetor 300 operable to perform under this new condition of predetermined reorientation of the standard operating position. All that needs to be done is to modify the pump and metering chamber body 306 in the manner shown in the engineering machine views of FIGS. 16–28 and as described hereinafter to provide the modified body 306'. Again, it is to be noted that these views are from machining drawings and are drawn to engineering scale, and the same incorporated herein by reference to supplement the description and disclosure, and likewise as to the previously referenced engineering machining views of FIGS. 3–13.

Figure 15:
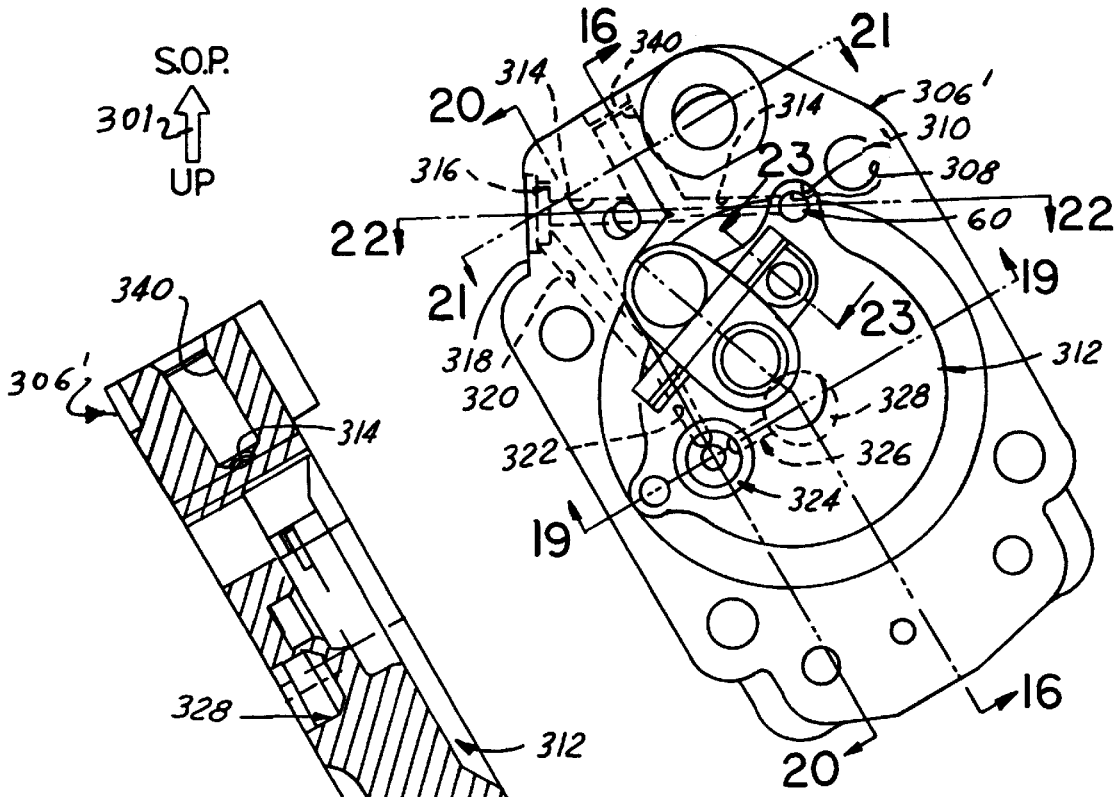
Figure 16:
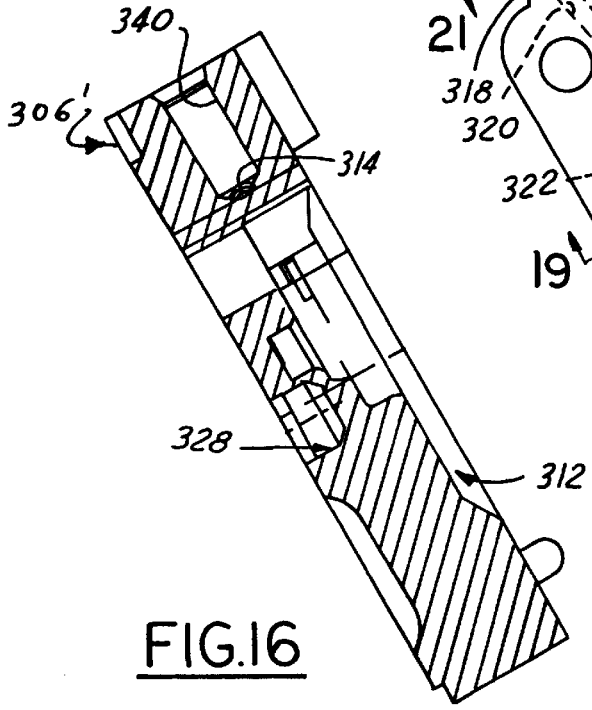
Figure 18:
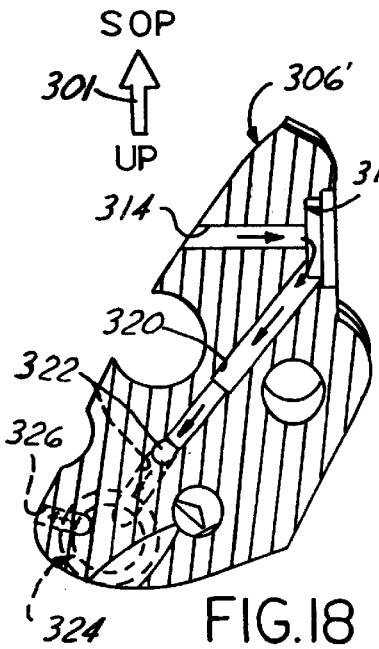
Figure 17:
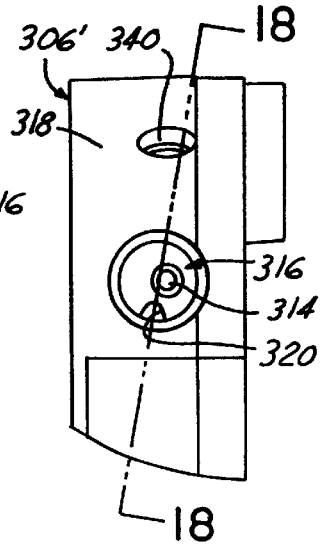
Figure 19:
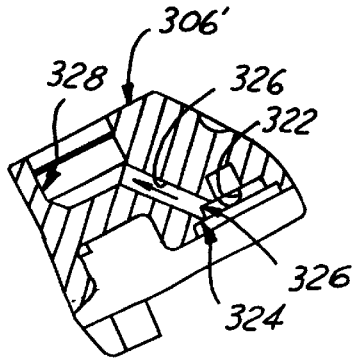
Figure 20:
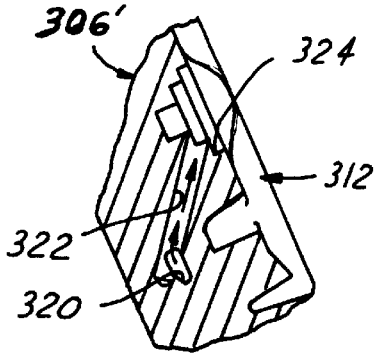
Figure 21:
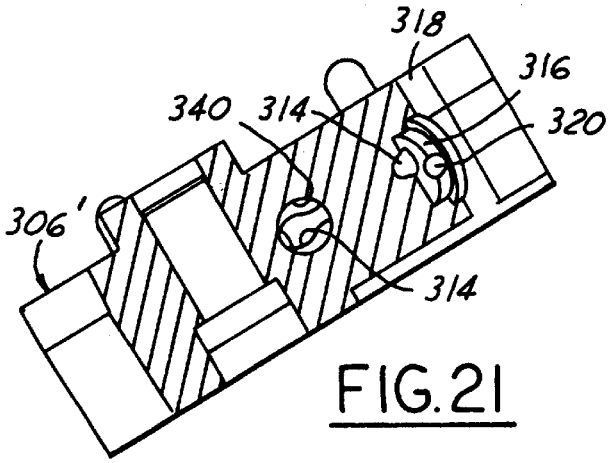
Figure 22:
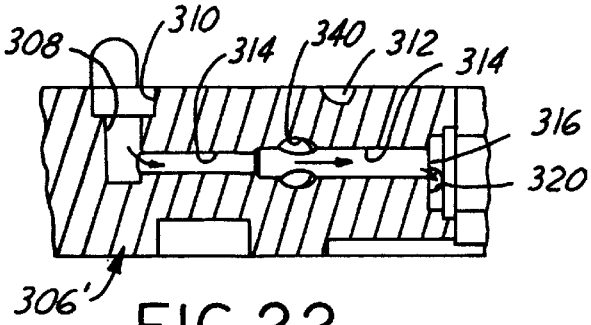
Figure 23:
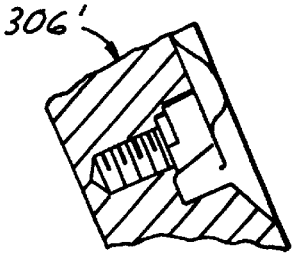
Figure 24:
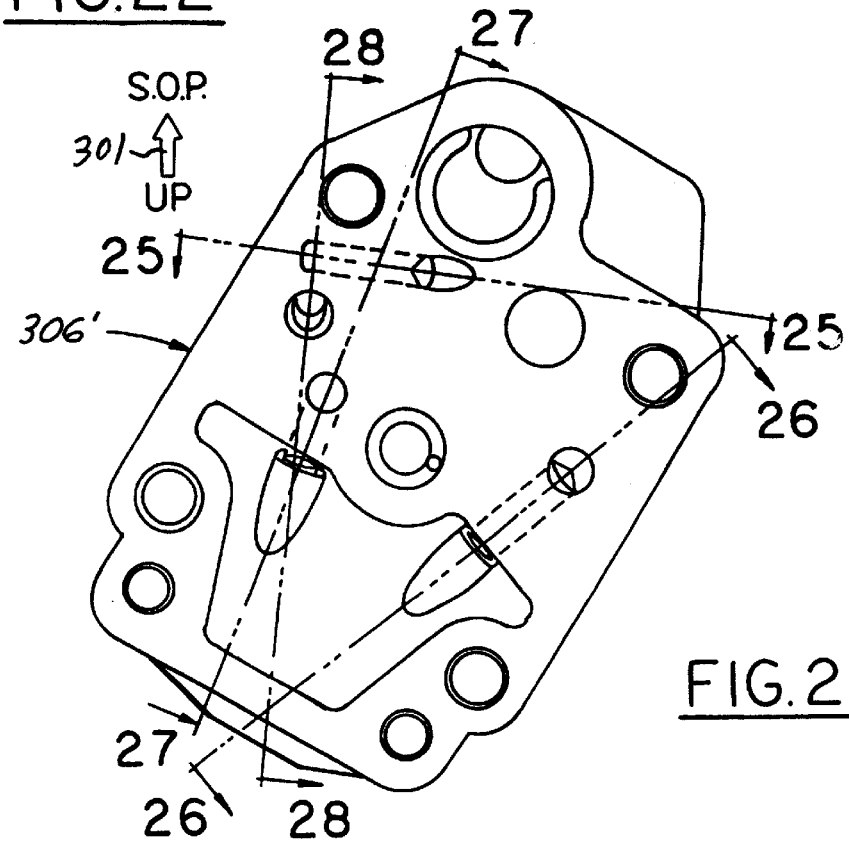
Figure 25:
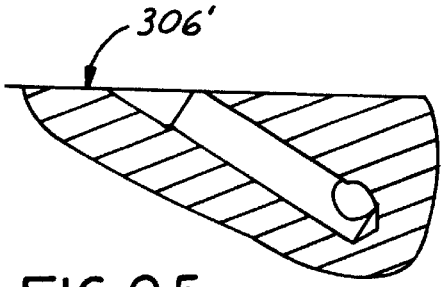
Figure 25:
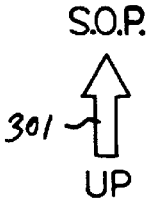
Figure 26:
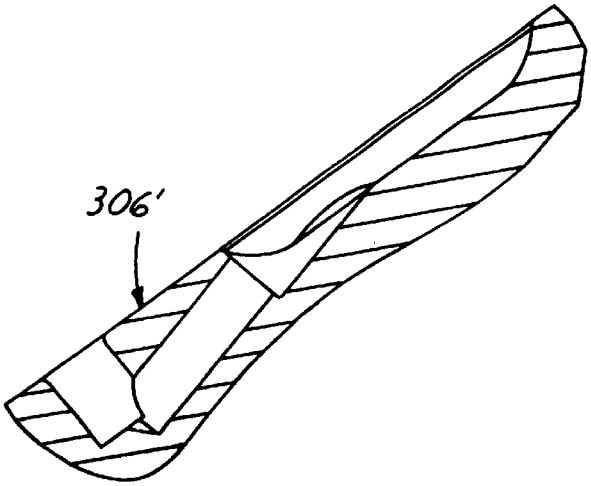
Figure 27:
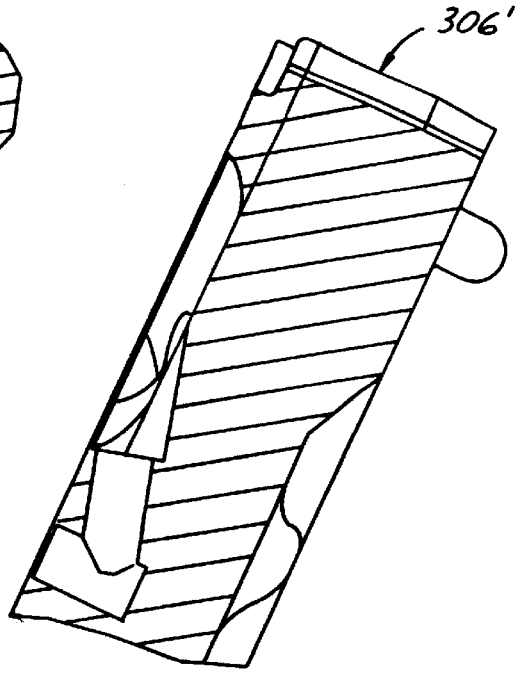
Figure 28:
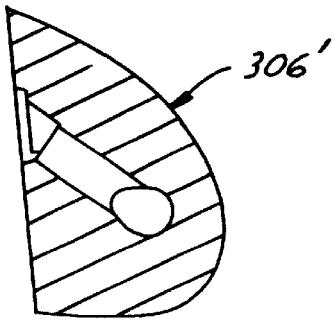

More particularly, it will be seen that the modified pump and metering chamber body 306' that is to be substituted for body 306 in carburetor 300 in accordance with the invention is shown oriented in a standard operating position per SOP orientation arrow 301 in FIG. 15. In this orientation for SOP 301 the highest elevation region in the metering chamber 312 is determined in advance for this orientation. As can be seen in FIG. 16 this highest elevation region point coincides with the common "high-point" fuel/purge take-off outlet from chamber 312 designated at 60. Therefore, a take-off passage is provided to have its inlet at the point 60 and is formed by a blind bore 308 opening into a counter bore 310 (FIGS. 15 and 22) which in turn communicates with the metering chamber 312 and is formed as a side enlargement thereof in the casting. Once the high-point pick-up location 60 is determined it is only necessary to route the passageway drillings and locate the interconnecting communicating wells to thereby connect the fuel feeding circuit into the pick-up point 60.

Accordingly, a stepped diameter passageway 314 (FIGS. 15, 17, 18 and 22) is drilled into body 306' so as to open at one end into counter bore 308 and at the other end into a connecting well cavity 316 located in a side face 318 of part 306'. Well 316 is counterbored to receive a sealing welch plug (not shown). Another drilled passageway 320 (FIGS. 15, 7, 18 and 20–22) runs from well 316 to an intersection with a further passageway 322 running from a connecting well 324 formed in that surface of the body cavity defining the metering chamber 312. Well 324 is likewise closed by a sealing welch plug (not shown). Still another fuel feeding passageway 326 (FIG. 19) is drilled off of well 324 to intersect the fuel feed circuit check valve cavity 328. With the foregoing fuel feeding passageway pick-up communication system provided from high-point 60 to the main check valve 313 of the fuel feeding circuit leading to the main nozzle 319 it will be seen that the aforementioned problems of instability at idle and poor acceleration performance will be overcome by high-point draw from the metering chamber of fuel admitted thereto during engine running.

Carburetor 300 likewise may be modified in accordance with the method of the invention to provide an improved air purge system connected into the side face 318 of body 306', as shown in FIGS. 15, 16, 17, 21 and 22. All that is required is to provide a suitable dimensioned and oriented bore 340 that intersects at its blind inner end of the first branch passageway 314 of the fuel feeding circuit so that the latter serves as a common pick-up point connector to the "high-point" fuel/purge pick-up blind bore pocket 308. The purge system bore 340 is of relatively large diameter and adapted to receive with a press fit a fitting 303 that connects to the protruding cylindrical inlet nipple of a squeeze bulb/air purge primer subassembly of conventional construction that has a body part with an inlet stem communicating with the inlet chamber of an umbrella valve provided in this subassembly (not shown) and of the same type as valve 33 described previously. The duck bill outlet of the umbrella valve communicates with a return nipple protrusion from the subassembly body which is connected to a line (not shown) to return the air and/or fuel so purged to the tank in the manner of return line 34 of carburetor 100. Hence, operation of the primer bulb of the primer subassembly, operates in the same manner as the purge primer bulb 32 of carburetor 100. Due to the connection of the inlet nipple or stem piece of the primer subassembly via a fuel line (not shown) and fitting 303 to bore 340 and connected by a passage 314 to the high-point pick-up 60, complete air pump out can be obtained prior to engine start-up despite the unusual orientation of the carburetor for the predetermined SOP orientation 301 as designated by the engine manufacturer and/or manufacturer of the engine-driven handheld appliance.

As will be evident from FIGS. 24 through 28, the fuel pumping circuit provided in carburetor pump and metering chamber body part 306' is not modified, nor indeed affected by, the provision of the cross drillings and connecting well cavities required to provide the foregoing fuel feed purging and air purging systems of the invention. Since the pumping circuit passageways and construction of the fuel pumping circuit associated with the fuel pumping cavity and the fuel pumping diaphragm is well known, no further detailed written description need be provided particularly in view of the engineering scaled views presented in the showings of FIGS. 24–28.

From the foregoing detailed description, and from the drawings referenced in conjunction therewith, it will now be apparent that the improved method of reducing gaseous phase presence in the liquid metering chamber of a diaphragm carburetor for an internal combustion engine amply fulfills the aforestated objects as well as other objects and provides many features and advantages over the prior art. The system, method and apparatus of the invention are unique and beneficial due to the fact that in a simple, economical and reliable manner they have resulted in a surprising improvement in all-position idle stability for mini-four-stroke engines. The invention is further advantageous in enabling use, by simple modification, of existing current design diaphragm carburetors that have been designed and manufactured hitherto primarily for two-stroke single cylinder light displacement engines. The system of the invention also assures that air bubbles and vapor are evacuated from the metering chamber during air purge system operation prior to engine start-up in those carburetors equipped with such air purge priming systems. During engine running the system of the invention improves acceleration performance in conjunction with supplying a fuel and air combustion mixture to a mini-four-stroke engine in those instances when the acceleration problems were due to air bubbles being trapped in the carburetor metering chamber. This is achieved with a minimal cost increase to the carburetor construction, such changes being primarily concentrated in the metering chamber body part of a multi-part carburetor assembly, thus requiring a minimal cost increase to the carburetor construction while providing a significant improvement in idle and wide open throttle (WOT) stability. Preferably, a common and single or sole pick-up passage is provided that serves both the fuel feeding circuit as well as the air purge system passageway circuit so that this pick-up point draws fuel from the metering chamber for operation of the engine during running, and prior to start-up draws fuel and/or air from the metering chamber to evacuate air from the fuel feeding system and metering chamber, thereby creating a negative presence that draws fuel past the inlet needle valve to fill the metering chamber to facilitate start-up of the engine. This system is compatible with either a built-in air purge system with a purge bulb mounted on the carburetor or with a so-called remote air purge system where the purge bulb and inlet and outlet valves are self contained as a separate subassembly connected via suitable lines and fittings.

It also will now be appreciated that the invention, by so determining what the specification is going to be for standard operation position and thereby ascertaining in advance for a given carburetor design where the high-point region will be in the metering chamber, provides an improved fuel feeding system that will now pull fuel during engine running from the area in the metering chamber where it would normally accumulate an air bubble from fuel vaporization or fuel cavitation. Although the formation of small bubbles in the liquid fuel cannot be prevented, the system of the invention does not allow them to increase in size but rather only remain as tiny bubbles, and as such they are sucked into the engine by carburetor aspiration. With initial purging of the metering chamber before the engine is started, utilizing the air purge high-point pick-up of the invention, almost all of the air bubbles are removed prior to start-up. Then any air bubbles that form during running by cavitation or from heat-induced vapor formation are rapidly sucked up through the fuel feeding system and into the engine because they migrate to the top of the metering chamber and are used up almost as rapidly as they are formed. Although such air and fuel vapor bubbles are drawn into the normal jets feeding into the main mixing passage or throat of the carburetor, they are drawn in as tiny bubbles that are too small to cause any problem in engine performance. Utilizing a common pick-up point both for running purge and for air purge prior to engine start-up ensures that all of the air is evacuated from the fuel feeding and metering chamber prior to start-up.

It will also be understood that if the carburetor is turned upside down while the engine is running engine performance will not be adversely affected inasmuch as the invention has provided an all-position diaphragm carburetor that is not plagued with air entrapment or collection in the metering chamber. Therefore gravitational orientation is not an adverse factor in the operation of the carburetor. Moreover, prior to start-up when the system is being air purged, the purging is done normally in the standard operating position (SOP). Likewise, for that matter, about 90% of handheld appliance engines are initially run in the standard operating position (SOP). So by operating the air purge system in a carburetor construction in accordance with the invention, once all of the bubbles are manually pumped out of the metering chamber, quite often the chamber will stay all solid fuel. Hence, the presence of bubbles will not be noticed or affect engine performance unless the carburetor gets excessively hot.

It will also be appreciated that the invention enables the carburetor, as mounted on a mini-four-stroke engine that in turn is mounted on a handheld appliance, to effectively become a bubble-self-cleaning system. If during running in an inverted position, as when working overhead, or what have you, an air bubble or vapor bubble or agglomeration of bubbles should build up remote from the pick-up point, when the appliance is returned to standard operation position the bubble may indeed cause the engine to stall. However, since purging is customarily done in the SOP position the system ensures that operating the air purge bulb will truly purge air. By contrast, with a prior art carburetor not modified in accordance with the invention, the appliance operator just could not easily clean it out of air bubbles or vapor lock. The operator needed to know which way to hold the engine to cause the air bubbles or vapor bubbles to gravitate upwardly to coincide with the take-off port communicating with the metering chamber. However, with the present invention it is always cleaned out by being oriented back in the standard operating position (SOP), where purging is normally done in any event. Moreover, assume that vapor lock from overheating does occur as the engine is running and while holding it in a non-standard operating position, so that excessive gaseous phase presence accumulates away from the pick-up point, and then the appliance is returned to standard operating position. As long as the engine is then throttled to wide open or the engine is "gunned", the system of the invention will automatically cause the air and/or vapor accumulation to be cleaned right out again from the metering chamber. Prior carburetors without the invention were not effective to accomplish this self cleaning or semi self cleaning action relative to vapor accumulation.

It will also be understood that as an initial design proposition, it would be preferable to design the casting that forms the metering chamber cavity to have several potential locations to provide a common solitary high-point pick-up location. The carburetor body part then would become a more universal design for production purposes, and the appropriate hole could be selected, for providing the air purge passageway system and the fuel feeding passageway system, from one of a variety of potential locations built into the carburetor as best suits the engine manufacturer's specification of SOP. Providing a plurality of such potential high-point pick-up locations would also reduce the amount of cross drilling through the body that would be required to modify the carburetor to incorporate the invention.

I claim:

1. A method of reducing gaseous phase presence in the liquid fuel metering chamber of a diaphragm carburetor for an internal combustion engine, such phase being in the form of air or fuel vapor agglomeration and/or bubble growth due to the same evaporating or effervescing from the liquid fuel during engine running and/or in the form of air when the chamber is not full of liquid fuel and hence air-filled due to carburetor fuel drain-down after engine-shut down, said method comprising the steps of:

(a) providing a diaphragm type carburetor having a main air/fuel mixing through passageway, a fuel metering cavity formed in a carburetor body part and a metering diaphragm spanning said metering cavity and defining a fuel metering chamber therebetween, a liquid fuel supply passageway coupled between a pressurized source of liquid fuel and said metering chamber, an inlet valve disposed in said supply passage and being operably coupled to the diaphragm for controlling opening and closing of said inlet valve to admit pressurized liquid fuel from the fuel source to the metering chamber in response to pressure differential between atmospheric pressure and engine-intake-induced negative pressure in the carburetor mixing passageway acting on the metering diaphragm, an engine fuel feed metering circuit passageway system having a first inlet operably communicating with the metering chamber and outlet means operably communicating via check valve means with the carburetor mixing passageway for supplying and metering liquid fuel from the metering chamber via the outlet means into the mixing passageway to form therein an air/fuel mixture for operating the engine, and an air purge passageway system including a fuel vapor and air purge passageway having a second inlet operably communicating with the metering chamber and an outlet adapted for operably communicating with a return line leading to the fuel source, said air purge passageway system also including a pump and associated intake and outlet valves operably coupled in said purge passageway for pumping gas and/or liquid from the metering chamber into the return line, (b) determining what will be the highest elevation region in the metering chamber with the carburetor mounted on the engine and the mounted carburetor and engine together being oriented in the standard operating position of the engine, and (c) locating said first and second passageway inlets to communicate with said highest elevation region of the metering chamber to thereby insure that substantially all such gaseous phase presence is removed from the metering chamber by operation of the passageway systems associated with said inlets at least when said engine is oriented in the standard operating position.

2. The method of claim 1 wherein said first and second inlets are constructed to communicate solely with a single common inlet opening directly into the highest elevation region of the metering chamber such that operation of said purge system, before starting the engine, removes substantially all gaseous phase metering chamber contents from the metering chamber and the fuel feed circuit while drawing liquid fuel into the metering chamber to thereby condition the carburetor for engine start-up with the engine oriented in the standard operating position, and such that while the engine is running in the standard operating position, the gaseous phase bubbles released from the liquid fuel, while resident in the metering chamber, are not allowed to become large enough, either singly or by agglomeration, to adversely affect engine performance when they are drawn into the engine via the fuel feed circuit.

3. The method set forth in claim 1 wherein the engine comprises a mini-four-stroke-cycle single cylinder engine having an engine displacement in the order of 20 to 35 cc and being adapted for use on a hand-held engine-driven appliance such as a weed-trimmer or the like.

4. The method set forth in claim 2 wherein said air purge pump comprises a manually operable squeeze bulb operably associated with said pump inlet and outlet valves and defining the variable volume pumping chamber of the air purge system.

5. The method set forth in claim 4 wherein said squeeze bulb is mounted on said carburetor.

6. The method of claim 1 wherein the outlet means of the engine fuel feed metering circuit passageway system includes both idle and high speed outlet fuel feeding orifice means both communicating with the metering chamber solely via the first inlet of the fuel feed metering circuit passageway system.

7. The method of claim 6 wherein said first and second inlets are constructed to communicate solely with a single common inlet opening directly into the highest elevation region of the metering chamber such that operation of said purge system, before starting the engine, removes substantially all gaseous phase metering chamber contents from the metering chamber while drawing liquid fuel into the metering chamber to thereby condition the carburetor for engine start-up with the engine oriented in the standard operating position, and such that while the engine is running in the standard operating position, the gaseous phase bubbles released from the liquid fuel, while resident in the metering chamber, are not allowed to become large enough, either singly or by agglomeration, to adversely affect engine performance when they are drawn into the engine via the fuel feed circuit.

8. The method of claim 7 wherein the engine comprises a mini-four-stroke-cycle single cylinder engine having an engine displacement in the order of 20 to 35 cc and being adapted for use on a hand-held engine-driven appliance such as a weed-trimmer or the like.

9. A method of reducing gaseous phase presence in the liquid fuel metering chamber of a diaphragm carburetor for an internal combustion engine, such phase being in the form of air or fuel vapor agglomeration and/or bubble growth due to the same evaporating or effervescing from the liquid fuel during engine running, said method comprising the steps of:

(a) providing a diaphragm type carburetor having a main air/fuel mixing through passageway, a fuel metering cavity formed in a carburetor body part and a metering diaphragm spanning said metering cavity and defining a fuel metering chamber therebetween, a liquid fuel supply passageway coupled between a pressurized source of liquid fuel and said metering chamber, an inlet valve disposed in said supply passage and being operably coupled to the diaphragm for controlling opening and closing of said inlet valve to admit pressurized liquid fuel from the fuel source to the metering chamber in response to pressure differential between atmospheric pressure and engine-intake-induced negative pressure in the carburetor mixing passageway acting on the metering diaphragm, an engine fuel feed metering circuit passageway system having a first inlet operably communicating with the metering chamber and outlet means operably communicating via check valve means with the carburetor mixing passageway for supplying and metering liquid fuel from the metering chamber via the outlet means into the mixing passageway to form therein an air/fuel mixture for operating the engine, (b) determining what will be the highest elevation region in the metering chamber with the carburetor mounted on the engine and the mounted carburetor and engine together being oriented in the standard operating position of the engine, and (c) locating said first passageway inlet to communicate with said highest elevation region of the metering chamber to thereby insure that substantially all such gaseous phase presence is removed from the metering chamber by operation of the engine fuel feed circuit passageway system associated with said first inlet whereby while the engine is running in the standard operating position the gaseous phase bubbles released from the liquid fuel, while resident in the metering chamber, are not allowed to become large enough, either singly or by agglomeration, to adversely affect engine performance when they are drawn into the engine via the fuel feed circuit.

10. The method set forth in claim 1 wherein the engine comprises a mini-four stroke cycle single cylinder engine having an engine displacement in the order of 20 to 35 cc and being adapted for use on a hand-held engine-driven appliance such as a weed-trimmer or the like.

11. The method of claim 9 wherein the outlet means of the engine fuel feed metering circuit passageway system includes both idle and high speed outlet fuel feeding orifice means both communicating with the metering chamber solely via the first inlet of the fuel feed metering circuit passageway system.

12. The method of claim 11 wherein the engine comprises a mini-four-stroke-cycle single cylinder engine having an engine displacement in the order of 20 to 35 cc and being adapted for use on a hand-held engine-driven appliance such as a weed-trimmer or the like.

13. In a diaphragm carburetor adapted for mounting and use on an internal combustion engine, and operable for reducing gaseous phase presence in a liquid fuel metering chamber of said diaphragm carburetor, such phase being in the form of air or fuel vapor agglomeration and/or bubble growth due to the same evaporating or effervescing from the liquid fuel during engine running and/or in the form of air when the chamber is not full of liquid fuel and hence air-filled due to carburetor fuel drain-down after engine-shut down, said carburetor having a main air/fuel mixing through passageway, a fuel metering cavity formed in a body part of said carburetor and a metering diaphragm spanning said metering cavity and defining a fuel metering chamber therebetween, a liquid fuel supply passageway coupled between a pressurized source of liquid fuel and said metering chamber, an inlet valve disposed in said supply passage and being operably coupled to said diaphragm for controlling opening and closing of said inlet valve to admit pressurized liquid fuel from the fuel source to the metering chamber in response to pressure differential between atmospheric pressure and engine-intake-induced negative pressure in the carburetor mixing passageway acting on the metering diaphragm, an engine fuel feed metering circuit passageway system having a first inlet operably communicating with the metering chamber and outlet means operably communicating via check valve means with the carburetor mixing passageway for supplying and metering liquid fuel from the metering chamber via the outlet means into the mixing passageway to form therein an air/fuel mixture for operating the engine, and an air purge passageway system including a fuel vapor and air purge passageway having a second inlet operably communicating with the metering chamber and an outlet adapted for operably communicating with a return line leading to the fuel source, said air purge system also including a pump and associated intake and outlet valves operably coupled in said purge passageway for pumping gas and/or liquid from the metering chamber into the return line, the improvement in combination therewith of said first and second passageway inlets being located to communicate with a gaseous phase collection and take off region of the metering chamber to thereby insure that substantially all such gaseous phase presence is removed from the metering chamber by operation of the passageway systems associated with said inlets, said take off region being located at the highest elevation in the metering chamber with the carburetor mounted on the engine and the mounted carburetor and engine together being oriented in the standard operating position of the engine.

14. The carburetor of claim 13 wherein said first and second inlets are constructed to communicate solely with a single common inlet opening directly into said highest elevation collection and take off region of the metering chamber such that operation of said purge system, before starting the engine, removes substantially all gaseous phase metering chamber contents from the metering chamber and the fuel feed circuit while drawing liquid fuel into the metering chamber to thereby condition the carburetor for engine start-up with the engine oriented in the standard operating position, and such that while the engine is running in the standard operating position, the gaseous phase bubbles released from the liquid fuel, while resident in the metering chamber, are not allowed to become large enough, either singly or by agglomeration, to adversely affect engine performance when they are drawn into the engine via the fuel feed circuit.

15. The carburetor set forth in claim 13 in combination with an engine comprising a mini-four-stroke-cycle single cylinder engine having an engine displacement in the order of 20 to 35 cc and being adapted for use on a hand-held engine-driven appliance such as a weed-trimmer or the like.

16. The carburetor set forth in claim 14 wherein said air purge pump comprises a manually operable squeeze bulb operably associated with said pump inlet and outlet valves and defining the variable volume pumping chamber of the air purge system.

17. The carburetor set forth in claim 16 wherein said squeeze bulb is mounted on said carburetor.

18. The carburetor of claim 13 wherein said outlet means of said engine fuel feed metering circuit passageway system includes both idle and high speed fuel feeding orifice means both communicating with the metering chamber solely via said first inlet of said fuel feed passageway system.

19. The carburetor of claim 18 wherein said first and second inlets are constructed to communicate solely with a single common inlet opening directly into said highest elevation collection and take off region of the metering chamber such that operation of said purge system, before starting the engine, removes substantially all gaseous phase metering chamber contents from the metering chamber while drawing liquid fuel into the metering chamber to thereby condition the carburetor for engine start-up with the engine oriented in the standard operating position, and such that while the engine is running in the standard operating position, the gaseous phase bubbles released from the liquid fuel, while resident in the metering chamber, are not allowed to become large enough, either singly or by agglomeration, to adversely affect engine performance when they are drawn into the engine via the fuel feed circuit.

20. The carburetor of claim 19 in combination with an engine comprising a mini-four-stroke-cycle single cylinder engine having an engine displacement in the order of 20 to 35 cc and being adapted for use on a hand-held engine-driven appliance such as a weed-trimmer or the like.

21. In a diaphragm carburetor adapted for mounting and use on an internal combustion engine, and operable for reducing gaseous phase presence in a liquid fuel metering chamber of said diaphragm carburetor, such phase being in the form of air or fuel vapor agglomeration and/or bubble growth due to the same evaporating or effervescing from the liquid fuel during engine running, said carburetor having a main air/fuel mixing through passageway, a fuel metering cavity formed in a body part of said carburetor and a metering diaphragm spanning said metering cavity and defining a fuel metering chamber therebetween, a liquid fuel supply passageway coupled between a pressurized source of liquid fuel and said metering chamber, an inlet valve disposed in said supply passage and being operably coupled to said diaphragm for controlling opening and closing of said inlet valve to admit pressurized liquid fuel from the fuel source to the metering chamber in response to pressure differential between atmospheric pressure and engine-intake-induced negative pressure in the carburetor mixing passageway acting on the metering diaphragm, an engine fuel feed metering circuit passageway system having a first inlet operably communicating with the metering chamber and outlet means operably communicating via check valve means with the carburetor mixing passageway for supplying and metering liquid fuel from the metering chamber via the outlet means into the mixing passageway to form therein an air/fuel mixture for operating the engine, the improvement in combination therewith of said first passageway inlet being located to communicate with a gaseous phase collection and take off region of the metering chamber to thereby insure that substantially all such gaseous phase presence is removed from the metering chamber by operation of said fuel feed metering circuit passageway system associated with said first inlet, said take off region being located at the highest elevation region in the metering chamber and being predetermined as to such location with the carburetor mounted on the engine and the mounted carburetor and engine together being oriented in the standard operating position of the engine, such that while the engine is running in the standard operating position, the gaseous phase bubbles released from the liquid fuel, while resident in the metering chamber, are not allowed to become large enough, either singly or by agglomeration, to adversely affect engine performance when they are drawn into the engine via the fuel feed circuit.

22. The carburetor set forth in claim 21 in combination with an engine comprising a mini-four-stroke-cycle single cylinder engine having an engine displacement in the order of 20 to 35 cc and being adapted for use on a hand-held engine-driven appliance such as a weed-trimmer or the like.

23. The carburetor of claim 21 wherein said outlet means of said engine fuel feed metering circuit passageway system includes both idle and high speed fuel feeding orifice means both communicating with the metering chamber solely via said first inlet of said fuel feed passageway system.

24. The carburetor of claim 23 in combination with an engine comprising a mini-four-stroke-cycle single cylinder engine having an engine displacement in the order of 20 to 35 cc and being adapted for use on a hand-held engine-driven appliance such as a weed-trimmer or the like.

* * * * *